US008187341B2

(12) United States Patent
Pacifici et al.

(10) Patent No.: US 8,187,341 B2
(45) Date of Patent: May 29, 2012

(54) FINISHING COMPOSITION THAT INHIBITS DYE BLEED FROM BASIC DYED NYLON FIBERS

(75) Inventors: Joseph Albert Pacifici, Anderson, SC (US); Daniel Graham Sims, Greenville, SC (US); Emily Jones Sims, legal representative, Greenville, SC (US)

(73) Assignee: Simco Holdings, Inc., Greenville, SC (US)

( * ) Notice: Subject to any disclaimer, the term of this patent is extended or adjusted under 35 U.S.C. 154(b) by 0 days.

(21) Appl. No.: 13/223,450

(22) Filed: Sep. 1, 2011

(65) Prior Publication Data

US 2012/0054969 A1 Mar. 8, 2012

Related U.S. Application Data

(60) Provisional application No. 61/402,781, filed on Sep. 3, 2010.

(51) Int. Cl.
*C09B 67/14* (2006.01)

(52) U.S. Cl. ..... 8/595; 8/115.51; 8/115.54

(58) Field of Classification Search ..... 8/115.51, 8/115.54, 595
See application file for complete search history.

(56) References Cited

U.S. PATENT DOCUMENTS

| | | | | |
|---|---|---|---|---|
| 4,822,373 | A | 4/1989 | Olson et al. | |
| 4,875,901 | A | 10/1989 | Payet et al. | |
| 4,937,123 | A | 6/1990 | Chang et al. | |
| 5,342,417 | A * | 8/1994 | Pacifici et al. | 8/685 |
| 5,843,328 | A | 12/1998 | Pacifici et al. | |
| 6,811,574 | B2 | 11/2004 | Baumann et al. | |
| 6,814,758 | B1 | 11/2004 | Pacifici et al. | |
| 6,852,134 | B2 | 2/2005 | Baumann et al. | |
| 2004/0123399 | A1 | 7/2004 | Baumann et al. | |
| 2005/0198743 | A1 | 9/2005 | Baumann et al. | |
| 2008/0127430 | A1 | 6/2008 | Self | |
| 2010/0291340 | A1 | 11/2010 | Brinkley | |

* cited by examiner

*Primary Examiner* — Eisa Elhilo
(74) *Attorney, Agent, or Firm* — Clements Bernard PLLC; Seth L. Hudson

(57) ABSTRACT

The present invention provides a process for improving the colorfastness, ozonefastness, and stainresistance of cationic dyeable nylon fibers dyed with basic dyestuffs wherein the process comprises the steps of treating the nylon fibers with a tannic acid product and then fixing the treated nylon fibers by a fixation method.

20 Claims, 2 Drawing Sheets

CADD Carpet
Kazan Style

FINISHING COMPOSITION THAT INHIBITS DYE BLEED FROM BASIC DYED NYLON FIBERS

CROSS REFERENCE TO RELATED PATENT APPLICATION

The current application claims the benefit of the earlier priority filing date of provisional application Ser. No. 61/402,781 that was filed on Sep. 3, 2010.

FIELD OF THE INVENTION

The present invention relates generally to minimizing dye loss caused by treatment of finishing agents on Cat-Acid Differentially Dyed (CADD) textile substrates, and more particularly relates to treating cationic dyeable nylon fibers with a tannic acid product for improving colorfastness, ozonefastness, and stainresistance of the cationic dyeable nylon fibers.

BACKGROUND OF THE INVENTION

Numerous types and colors of dyestuffs are used in the textile industry for coloration of fibers, yarns, fabrics, etc. in order to impart aesthetic properties to consumer goods. There are myriads of books, publications, patents, etc. that are available describing dyeing processes, methodologies, and equipment used in manufacturing dyed textile goods. A good source of information is contained in a book of papers reprinted from Textile Chemist and Colorist called Dyeing Primer. These papers discuss all the dyestuffs types according to the fibers they are designed to color. Contained in Dyeing Primary, for example, is a paper devoted to dyeing cotton (cellulosic) fibers with Fiber Reactive dyes. There is a paper that addresses dyeing polyarnide fibers such as nylon or wool with Acid dyes. Another paper discusses the use of Basic dyes for dyeing acrylic fibers or "modified" nylon fibers.

The scope of the invention is to minimize the dye loss caused by treatment of finishing agents on Cat-Acid Differentially Dyed (CADD) textile substrates while imparting colorfastness, ozonefastness, and stainresistance. More specifically, the invention addresses the color change caused by the treatment of finishing agents on CADD carpet products manufactured with two classes of dyeable fibers to produce a multicolored carpet style. One class of dyeable fibers, commonly referred to as "acid dyeable fibers" have cationic chemical functionalities which readily accept dyes with anionic chemical functionalities, also commonly referred to as acid dyes. A second class of dyeable fibers, commonly referred to as "cationic dyeable fibers" have anionic chemical functionalities which readily accept dyes with cationic chemical functionalities, also referred to as basic dyes with the basic dyes having poor to marginal colorfastness to ozone.

The problem occurs when CADD nylon carpet styles are treated with a typical stainblocker finishing agent. Conventional stainblockers contain anionic chemical functionalities needed for reaction with acid dyeable nylon fibers. The stainblockers impart to acid dyeable nylon carpets stainresistance to colorants (food grade dyes) contained in food and drink products. Unfortunately, the anionic stainblocker will also remove basic dyestuffs from the cationic dyeable nylon component of a CADD nylon carpet. This dye loss significantly affects the colorfastness of the cationic dyeable nylon fibers to the finishing agent thus the original shade of the carpet. The loss of basic dye can be observed as color bleed in a batch dyebath or in the rinse water depending on the treatment method of the stainblocker. The shade change that occurs is the critical problem. Loss of basic dyestuff lightens the cationic dyeable nylon shade. Any level of basic dye removal that affects the overall shade of the multicolored carpet is unacceptable and precludes the use of a stainblocker finishing agent. At present no CADD nylon carpet products are treated with a stainblocker for stainresistance.

The color loss caused by stainblocking is a serious problem because the inability to use a stainblocker on a carpet product limits that product's marketability. Since 1985 stainblockers have been used to treat acid dyeable nylon carpets in order to prevent colorant stains caused by spills of food and drink products. The original stainblocker was Stainmaster® by DuPont. Today the three prevalent stainblockers are the SAC type, the methacrylate type, and the maleic acid type. Information regarding these stainblockers is disclosed in U.S. Pat. Nos. 4,822,373; 4,875,901; 4,937,123; 5,843,328; 6,814,758 as well as numerous other patents.

In general, stainblockers are applied to acid dyeable nylon fibers. This type of nylon fiber is one of the fibers used in CADD carpet styles. Carpets or carpet yarns made from acid dyeable nylon fibers are either dyed with acid dyes at the carpet manufacturer or dyed by solution dye methods at the fiber producer. In either event stainblockers are applied to the dyed carpets and fixed by either a wet heat treatment method or a dry heat treatment method. The wet heat fixation method is accomplished by either a batch (hot/boiling) water method or continuous steam method. Dry heat fixation is accomplished in drying or coating ovens.

In some carpets stainblockers are not necessary. These are carpets made from cationic dyeable nylon fibers, the other fiber used in CADD carpets. The reason is that unlike acid dyeable nylon fibers which contain amine end groups and are positively charged, cationic dyeable nylon fibers contain sulfonate end groups and therefore negatively charged. Because of ionic fiber/colorant charge repulsion, cationic dyeable nylon fibers have intrinsic stainresistance to acid colorants contained in food and drinks and therefore require no chemical stainblocker treatments. Coloration of cationic dyeable nylon carpets is achieved mostly by using solution dyed nylon fiber supplied by the fiber producer. Some, however, are dyed with acid and pre-metalized acid dyes by the process disclosed in U.S. Pat. No. 5,085,667 at the carpet manufacturer. Regardless of coloration method, basic dyes are not used on cationic dyeable carpets. Only CADD carpets use basic dyes.

CADD carpets are dyed by batch processing using a beck dye machine. The carpet is loaded in the dye machine and water is added. The dyeing procedure is done by adding both acid and basic dyestuffs to the dyebath. Special chemicals are also added in order to stabilize the two dyestuffs. At the end of the dyeing a multicolored carpet style is achieved. After dyeing, the carpet is rinsed, dried, and finished. Because color bleed is problematic, a stainblocker finishing agent cannot be applied, only an anti-soiling finishing agent.

There are economic, logistic, and manpower advantages to being able to produce multicolored carpets using CADD carpet dye methodology versus conventional methods. Conventionally, a multicolored carpet is manufactured by tufting yarns of different colors into a carpet product. This requires that acid dyeable yarns be dyed in yarn dye equipment and solution dyed yarns be purchased from fiber produces. In either event, each yarn color is a separate SKU that must be manufactured or purchased in an amount to correspond to customer orders. Typically excess dyed yarns are produced or purchased and have to be cataloged and inventoried. Most yarn dye equipment requires a good deal of floor space, support equipment, material handling, and personnel.

In CADD carpet styles un-dyed carpet yarns are tufted into a certain pattern style into a big stock item roll, a style SKU. The yarns are un-dyed at this stage. If there is an order, for example, for a certain square yardage of a blue and green multicolored pattern, that amount of square yards is simply pulled from the stock item roll and dyed in one operation in a beck machine. Using the example above, the conventional method would require having two yarn SKUs, one for blue yarns and the other for green yarns. These yarns are tufted into a carpet. The style SKU would be the same for either the CADD or conventional method, but the conventional method would require two yarn SKUs as well as additional manufacturing cost to produce dyed yarns.

The major disadvantage discussed earlier imposed by the use of CADD carpet is that conventional stainblockers cause bleeding of the basic dyes; therefore, CADD styles are not stainresistant to acid colorants as measured by AATCC Test Method 175. This limits their viability for use in the carpet industry.

There have been several efforts to try to impart stainresistance to CADD carpets while trying to prevent the loss of shade due to color bleed. Processes directed to this end are disclosed in U.S. patents and patent application U.S. Pat. Nos. 6,852,134; 6,811,574; 2008/0127430; 2005/0198743; and 2004/0123399. All of these disclosures are directed toward using problematic stainblocker chemistry in methods comprising low temperatures or short dwell time methodologies or reverse application processes. The idea is to try to get an acceptable stain rating by AATCC Test Method 175 while reducing the color loss of the basic dye caused by the stainblocker.

The problem with the inventions disclosed above is that manufacturing plants would have to invest in expensive new equipment that is only useful for CADD carpets or have application procedures that would require exact repeatable process conditions. Neither of these situations is desirable at a carpet manufacturing plant.

In addressing the problem of stainblocking CADD carpets we have discovered a finishing composition that will impart stainresistance and colorfastness to CADD carpet styles without removing any basic dye from the cationic dyeable nylon fibers. Specifically, we have discovered that tannic acid has the ability to impart to CADD carpets stainresistance to acid colorants, neutral colorants, and chemical agents without removing any basic dye from the cationic dyeable nylon fiber portion of the CADD carpet styles. More specifically, tannic acid can be applied to CADD carpet styles by the wet heat fixation methods disclosed in U.S. Pat. No. 6,814,758.

BRIEF SUMMARY OF THE INVENTION

According to an embodiment of the present invention, a process for improving the colorfastness, ozonefastness, and stainresistance of cationic dyeable nylon fibers dyed with basic dyestuffs is disclosed. The process includes the steps of treating the nylon fibers with a tannic acid product and then fixing the treated nylon fibers by a fixation method.

According to another embodiment of the present invention, the process for improving the colorfastness, ozonefastness, and stainresistance of cationic dyeable nylon fibers dyed with basic dyestuffs that include treating the nylon fibers with at least about 0.6% of tannic acid.

According to yet another embodiment of the present invention, the process for improving the colorfastness, ozonefastness, and stainresistance of cationic dyeable nylon fibers dyed with basic dyestuffs that include treating the nylon fibers with tannic acid in the range from about 0.6% owf to about 5% owf.

According to yet another embodiment of the present invention, the process for improving the colorfastness, ozonefastness, and stainresistance of cationic dyeable nylon fibers dyed with basic dyestuffs that include treating the nylon fibers with tannic acid in the range from about 2% owf to about 5% owf.

According to yet another embodiment of the present invention, the process for improving the colorfastness, ozonefastness, and stainresistance of cationic dyeable nylon fibers dyed with basic dyestuffs that result in the cationic dyeable nylon having a stain resistance of about 8 or higher on the AATCC TM 175 scale.

According to yet another embodiment of the present invention, the process for improving the colorfastness, ozonefastness, and stainresistance of cationic dyeable nylon fibers dyed with basic dyestuffs that result in the cationic dyeable nylon having a color change of about 4 or higher on the AATC Grey Scale for color change.

According to yet another embodiment of the present invention, the process for improving the colorfastness, ozonefastness, and stainresistance of cationic dyeable nylon fibers dyed with basic dyestuffs that include the steps of treating the nylon fibers with a tannic acid product and then fixing the treated nylon fibers by the wet heat method.

According to yet another embodiment of the present invention, the process for improving the colorfastness, ozonefastness, and stainresistance of cationic dyeable nylon fibers dyed with basic dyestuffs that include treating the nylon fibers with a food grade quality tannic acid.

According to yet another embodiment of the present invention, the process for improving the colorfastness, ozonefastness, and stainresistance of cationic dyeable nylon fibers dyed with basic dyestuffs that include the wet heat batch method.

According to yet another embodiment of the present invention, the process for improving the colorfastness, ozonefastness, and stainresistance of cationic dyeable nylon fibers dyed with basic dyestuffs that include the wet heat continuous steam method.

BRIEF DESCRIPTION OF THE DRAWINGS

The present invention is illustrated and described herein with reference to the various drawings, in which like reference numbers denote like method steps and/or system components, respectively, and in which.

DETAILED DESCRIPTION OF THE INVENTION

Figure 1:
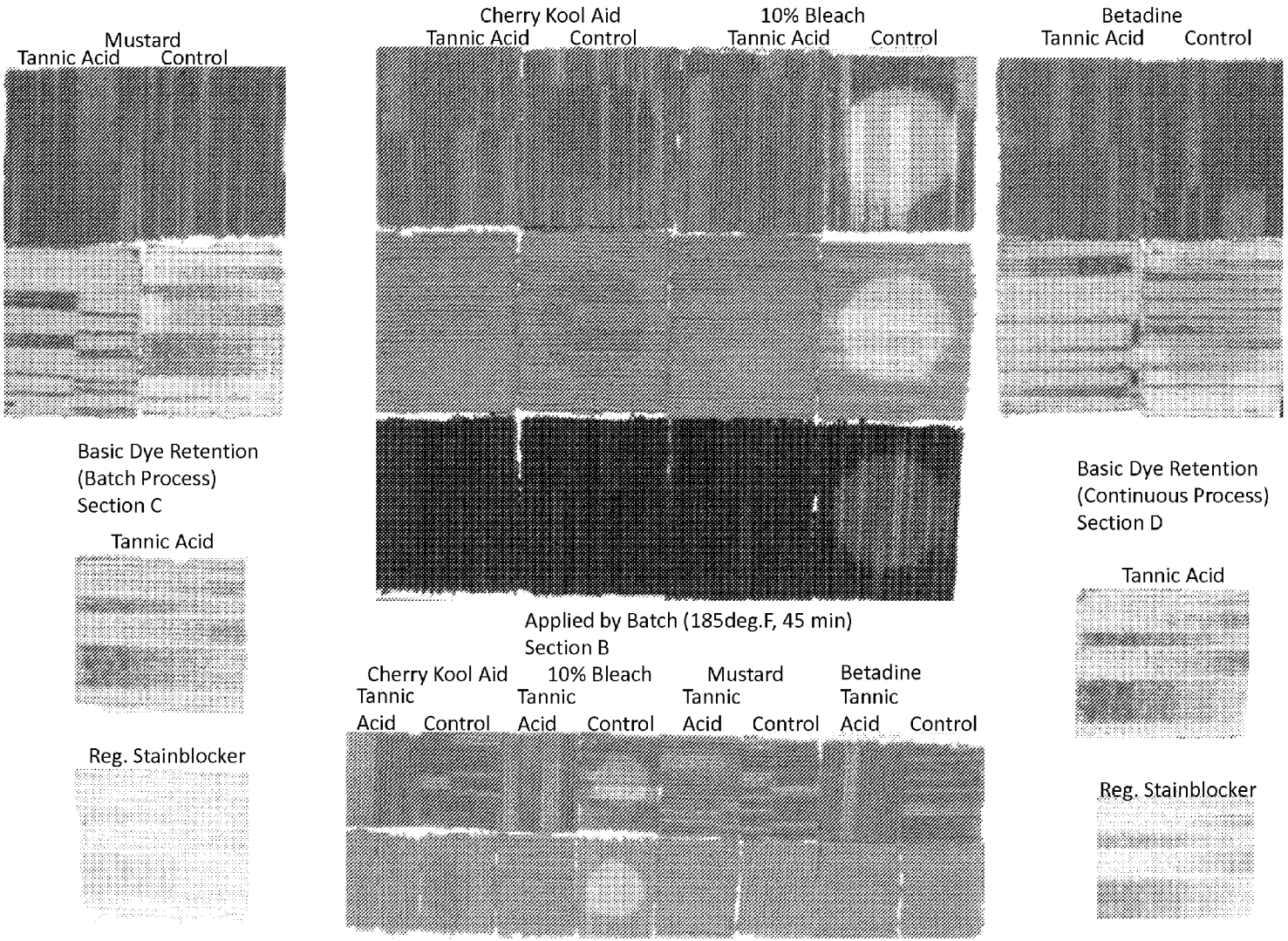
FIG. 1 is an example indicating the stainresistance and colorfastness results of four experiments using CADD carpet samples supplied by Mohawk®.

The process of the present invention is particularly useful for preparing cat-acid differentially dyed (CADD) textile substrates, and in particular using a tannic acid product as a stainblocker finishing agent for CADD textile substrates, and particularly CADD carpets. By using the process of the present invention, the problem associated with the treatment of finishing agents on CADD carpet products, resulting in color change, has been addressed. The process of the present invention minimizes the dye loss, causing color change, caused by the treatment of finishing agents on CADD textile substrates. Nylon fibers are treated with a tannic acid product and then the nylon fibers are subjected to a wet heat fixation method. The tannic acid product is preferably in the range of from about 0.6% owf to about 5% owf, including all points in-between. The nylon fibers produced by the process of the present invention have an improved colorfastness, ozonefastness, and stainresistance as compared to prior art nylon fibers incorporated into CADD textile substrates.

The viability of using tannic acid as the stainblocker finishing agent for CADD carpets was tested in several differentiating experiments. The original experiments were lab directed (Experiment 1a and 1b) using small swatches of CADD carpet styles supplied by Mohawk® Industries. Later experiments were done on larger samples (Experiment 2a and 2b) on a three foot wide pilot carpet application machine at Mohawk® Industries and a similar machine at Invista® Corporation. A production trial (Experiment 3) of several hundred square yards of CADD carpet was conducted in the Dublin facility of Mohawk® industries using a continuous steam method equipped with a foam applicator system.

The process of the present invention will described by the following examples which are provided for illustrative purposes only and are not to be construed as limiting the invention.

EXAMPLES

Experiment 1a

Experiment 1a is a lab study is to evaluate the colorfastness and stainresistance of cationic dyeable nylon fibers dyed with basic dyestuffs. More specifically, it is directed to Cat-Acid Differentially Dyed (CADD) nylon carpets that have been treated with stainblocker finishing agents. Four CADD carpet samples in the style Kazan provided by Mohawk® Industries. The samples contained both acid dyeable and cationic dyeable nylon fibers manufactured by Solutia®. Three samples were dyed with both acid and basic dyes in a light, medium, and dark shade. A forth sample was dyed with a basic blue dye on the cationic dyeable component only with the acid dyeable nylon component left un-dyed.

Four staining materials were used to apply to the carpets and then evaluate the stainresistance of the treated CADD carpets as compared to untreated Controls. These are Cherry Kool-Aid®, French's® yellow mustard, Betadine solution, and 10% Clorox® bleach solution. The Clorox® bleach actually does not stain but causes color loss through dye fading.

Two products were evaluated for stainresistance and color retention: (1) tannic acid, and (2) a regular stainblocker. Tannic acid products used to demonstrate the method of the present invention are food grade quality obtained from Colonial Chemical Company in Savannah Ga. and Esprix Technologies in Sarasota Fla. The advantage of the food grade quality is that they contain almost no insoluble impurities. Food grade tannic acids are processed and purified to a level that contains very few, if any, insoluble purities. Lower grades of tannic acid work as well to demonstrate the invention but they contain insoluble impurities, such as precipitates. These precipitates cause build up in application equipment requiring more frequent maintenance.

Regular stainblocker used for this experiment is an SAC type. More specifically it is the Simcofix N-201A used in U.S. Pat. No. 6,814,758, Pacifici et al. The SAC type of stainblocker is more anionic than the methacrylates by 3M and the maleic anhydride type by DuPont and therefore causes more dye loss in the treatment process. The non-sulfonated type stainblockers from 3M and DuPont, however, still cause unacceptable color loss. In addition, their stainresistant performance is limited to only acid colorants.

The preferred level of tannic acid applied to CADD carpets depends on what level of stainresistance performance is required. At levels of about 5% tannic acid owf (on weight of fiber) the stainresistance to Cherry Kool-Aid®, French's® yellow mustard, Betadine solution, and colorfastness to 10% Chlorox® bleach can be achieved. If only stainresistance to Kool-Aid® and 10% Chlorox® bleach are needed then a level of tannic acid at about 2% owf is sufficient.

In experiment 1a, an application level of 5% owf of tannic acid and regular stainblocker was chosen for application to CADD carpets. There are two application processes used to treat and fix the tannic acid and regular stainblocker to CADD nylon carpets. Both processes are wet heat fixation methods that are disclosed in U.S. Pat. No. 6,814,758, which is incorporated herein by reference. The wet heat method is done in either of two ways: (1) the wet heat batch method, or (2) the wet heat continuous steam method. The wet heat continuous steam method involves applying the tannic acid as an aqueous mix to either carpet, carpet yarns, or nylon sock and steaming the goods for several minutes to fix the tannic acid to the fibers. The wet heat batch method involves applying the tannic acid to a treatment bath, then submerging the carpet, carpet yarns, or carpet fibers into the bath. The bath is heated to elevated temperatures and held for several minutes to fix the tannic acid to the nylon fibers.

In the present example using the wet heat batch method, the preferred condition is to submerge the CADD carpets in an aqueous bath containing tannic acid. The bath is heated to 185° F., and held for 45 minutes. The samples are then rinsed, dried, and tested. Other time/temperature conditions may also be suitable.

In the present example using the wet heat continuous steam method, the preferred condition is to add a solution of tannic acid at about 200% wet add-on on the CADD carpet and steam the carpet for about 4 minutes. The samples are rinsed, dried, and tested. Other add-on/time conditions may also be suitable.

The method for evaluating the stainresistance of CADD carpets that are treated and untreated is a modification of the AATCC Test Method 175. A staining solution or material is placed on the CADD carpet samples and left for 24 hours. The samples are then rinsed to remove any excess staining material, extracted, and dried.

The dried samples are rated for stainresistance by two rating scales. The Cherry Kool-Aid®, mustard, and Betadine solution are rated by the AATCC TM 175 scale of 1-10 wherein a rating of 1 is heavy staining and 10 is no stain. The 10% bleach is rated by the AATCC Grey Scale for Color Change of 1-5 wherein a rating of 1 is heavy dye fading and 5 is no dye fading. The AATCC Grey Scale for Color Change is also used to evaluate the retention of basic dyestuffs on the cationic dyeable nylon component of CADD carpets. The untreated shade is compared to the treated shade. No color loss would be rated a 5 and severe color loss would rate a 1.

Figure 2:
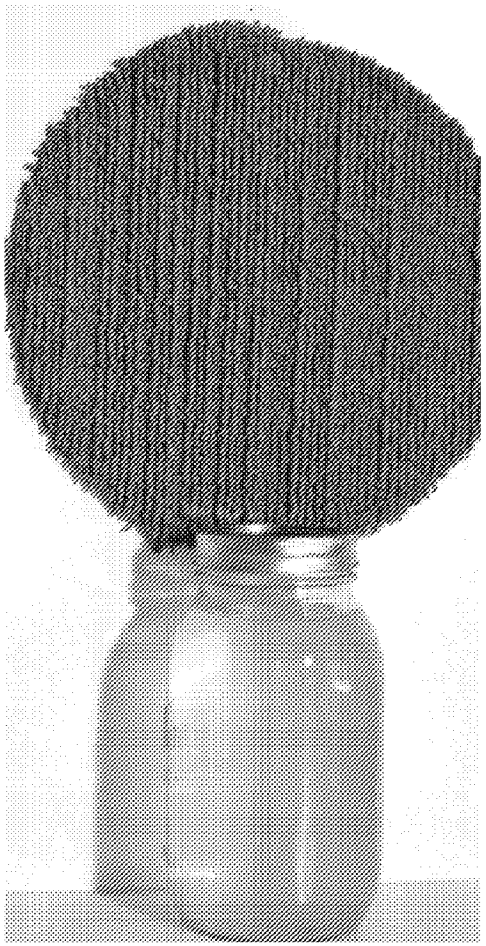
FIG. 2 is an example demonstrating the colorfastness of cationic dyeable nylon fibers dyed with basic dyes when the CADD carpet samples are treated with stainblocker finishing agents.
Figure 2:
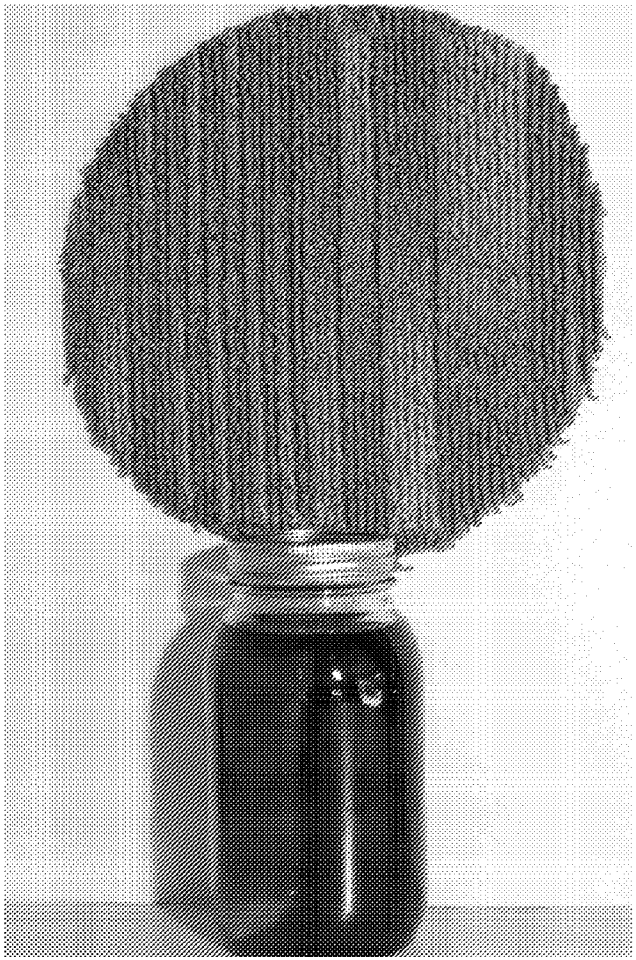

FIG. 1 demonstrates stainresistance and colorfastness results of four different experiments using the CADD carpet samples supplied by Mohawk®. The display board of samples is divided into four sections, A, B, C, & D. FIG. 2 demonstrates the colorfastness of Kazan style color 628 to tannic acid and an SAC stainblocker. Section A demonstrates the stainresistance of CADD carpets treated with tannic acid using the wet heat continuous steam fixation method. The tannic acid samples are treated with 5% owf tannic acid by applying a 2.5% solution of tannic acid at 200% add-on to the carpet samples. The treated carpet samples are then steamed for 4 minutes to fix the tannic acid to the nylon fibers. The Control samples are left untreated.

After the samples are rinsed and dried four staining solutions are applied. Cherry Kool-Aid® and 10% bleach are applied on the light, medium, and dark shade of the Kazan style carpet supplied by Mohawk®. Mustard and 10% Betadine are applied on the medium shade and the basic dyed only shade of the Kazan style carpet. The stainresistance of the samples are rated according to the protocols described in AATCC TM 175 and the AATCC Grey Scale for Color Change.

The test results on the untreated Control samples show unacceptable stainresistance and color change ratings. The stainresistance from mustard, Kool-Aid®, and Betadine would rate a 2-3 (10 max) on the AATCC TM 175 scale. The color change from 10% bleach would rate a 1-1.5 (5 max) on the AATCC Grey Scale for Color Change.

The test results on the tannic acid treated samples show acceptable stainresistance and color change ratings. The stainresistance ratings would be 8-10 and the color change ratings 4.5-5.

Section B demonstrates the stainresistance of CADD carpets treated with tannic acid using the wet heat batch fixation method. The tannic acid samples are treated by adding 5% owf of tannic acid in a treatment bath with the carpet samples. The temperature of the bath is raised to 185° F. and held for 45 minutes to fix the tannic acid to the nylon fibers. The Control samples are left untreated.

After the samples are rinsed and dried, the staining solutions discussed in Section A are applied and the same protocols are followed. The CADD samples used in this section are the light and medium shade of the Kazan carpet.

The stainresistance and color change results very closely follow the results demonstrated in Section A. Stainresistance and color change ratings are unacceptable on the untreated CADD samples but are acceptable on the tannic acid treated samples.

Sections C, D, and FIG. 2 demonstrate the colorfastness of cationic dyeable nylon fibers dyed with basic dyes wherein the CADD carpet samples are treated with stainblocker finishing agents. In Sections C and D, the CADD carpet sample used is the Kazan style where only the cationic dyeable fibers are dyed. In FIG. 2, the carpet sample is a standard production CADD nylon carpet style Kazan, color number 628. It is the same carpet identified as the light shade used in Sections A and B.

In section C and in FIG. 2, the samples are treated by the wet heat batch fixation method. Two chemical products are used as the stainblocker, tannic acid and an SAC conventional stainblocker. Since this is a batch method, the treatment bath was also retained to observe any dyestuffs that would bleed into the treatment bath.

In Section D, the samples are treated with the same chemicals in Section C and FIG. 1 except by the wet heat continuous fixation method. In this method there is no liquid to retain although one can observe if dyestuffs appear in the rinse step.

The results shown in Sections C, D, and FIG. 2 that samples treated with a conventional stainblocker experience heavy dye loss, therefore color change, on the cationic dyeable nylon fibers dyed with basic dyes. Those samples treated with tannic acid show essentially no dye loss, therefore color change. The residual treatment baths also confirm a heavy dye bleed in those baths originating from treatment with a conventional stainblocker.

The results in FIG. 1, Sections A-D and FIG. 2 show that tannic acid can impart stainresistance and colorfastness to CADD nylon carpets without loss of basic dye on the cationic dyeable component. Conventional stainblockers significantly affect the shade by stripping basic dye off the cationic dyeable nylon fibers.

Experiment 1b

The purpose of experiment 1b is to evaluate a fifth staining product, benzoyl peroxide. Benzoyl peroxide is the active ingredient in acne care products and tends to affect the colorfastness of dyed nylon carpets in the same manner as 10% bleach. The dyestuffs are destroyed thus causing the shade to fade. The light shade of CADD carpet as shown in FIG. 1 was treated and tested in the same manner disclosed in Experiment 1a, section A. The only difference was an acne wash product, OXY 10®, was applied to the treated and untreated control samples. The colorfastness of the tannic acid treated sample was acceptable while the control sample was unacceptable.

Experiment 2a

Experiment 2a is a pilot study to evaluate the stainresistance to Red Dye 40 (Cherry Kool-Aid®) and the colorfastness to 10% bleach, light, $NO_2$, and ozone of a CADD nylon carpet treated with tannic acid. The equipment used in this study was a three foot wide pilot carpet range. The carpet range is designed to apply dyes and chemicals by the wet heat continuous steam fixation method. In this study the Kazan style, color 628 was used to demonstrate the invention.

Three application levels of tannic acid and two steam times were evaluated to determine optimal conditions for production applications. The levels of tannic acid were 0.6, 1, 2, and 3% owf. The steam times were 3.5 and 5 minutes.

Table 1 shows the results of the stainresistance and colorfastness on CADD nylon carpet.

TABLE 1

| Tannic Acid % owf | Steam Min. | Stain Red 40 | Bleach 10% | Light 40 hr | $NO_2$ 1 Cycle | Ozone 3 Cycles |
|---|---|---|---|---|---|---|
| 0 | N/A | 5 | 1 | 3-4 | 4 | 1 |
| 0.6 | 3.5 | 7 | 2 | 4-5 | 4 | 1 |
| 0.6 | 5 | 6 | 2 | 4 | 4 | 1 |
| 1 | 3.5 | 10 | 3 | 4 | 4 | 1 |
| 1 | 5 | 7 | 3 | 4 | 4 | 1 |
| 2 | 3.5 | 10 | 4 | 4-5 | 4 | 4 |
| 2 | 5 | 10 | 4 | 3-4 | 4 | 3-4 |
| 3 | 3.5 | 10 | 4-5 | 4 | 4 | 4 |
| 3 | 5 | 10 | 4-5 | 3-4 | 4 | 3-4 |

In this experiment Red Dye 40 (also contained in Cherry Kool-Aid®) solution is used as the staining material in order to rate stainresistance to acid colorants by AATCC Test Method 175 protocol. In AATCC TM 175 a rating of 8 or above is acceptable. The 10% bleach, light, $NO_2$, and ozone are rated by the AATCC Grey Scale for Color Change. A color change rating of 3-4 or above is acceptable.

The results in Table 1 where no tannic acid is applied show very unacceptable stain and colorfastness ratings with Red Dye 40, 10% bleach, and ozone. Light and $NO_2$ are acceptable.

The results of ratings of samples treated with tannic acid vary according to application level and steam time. In general, however, tannic acid applied at 2% owf or better regardless of steam time show acceptable ratings in both stainresistance and colorfastness. Most important, however, no color change or shade loss was observed on any of the treated samples in this study.

Experiment 2b

Experiment 2b is similar to Exp. 2a except that the study was conducted on a three foot pilot carpet range using the wet heat continuous steam fixation method. Three pilot trials were run on a special test carpet used by Invista® for evaluating results of CADD carpet trials. The three foot wide carpet had one section made with dyed acid dyeable nylon. A second section was made with dyed cationic dyeable nylon with a third section containing both. An advantage of this test carpet is that stainresistance and colorfastness of each type fiber can be evaluated separately as well as together.

Three application levels of tannic acid and one steam time were evaluated on the treated carpet fiber sections for stainresistance to Red Dye 40 and colorfastness to 10% bleach. The levels of tannic acid applied to the special carpet samples were 1, 2, 3% owf. The steam time was 1.5 minutes. The observed results on the acid dyeable nylon section of the test carpet show a 3% owf tannic acid treatment level is needed to achieve an acceptable stainresistance to Red Dye 40. An acceptable colorfastness to 10% bleach, however, only required a treatment level of 1% owf tannic acid.

The observed results on the cationic dyeable nylon section of the test carpet show that the colorfastness to 10% bleach required at least a 2% owf treatment level of tannic acid.

Stainresistance to Red Dye 40, however, is inherent in cationic dyeable nylon fibers; therefore, an acceptable stainresistance would require no tannic acid treatment unless stainresistance to mustard and Betadine had been required. The observed results on the CADD part of the special carpet sample showed that a treatment level of 2% owf tannic acid would have been sufficient to achieve both stainresistance and colorfastness.

The most important observation that demonstrated the scope of the invention, however, was that almost no color change occurred on the basic dyed cationic dyeable nylon section of the test carpet. The AATCC Grey Scale for Color Change rating would be at least a 4-5 for the basic dyed section.

Experiment 3

Experiment 3 evaluated 12 foot wide CADD carpet on production equipment, more specifically a Kuster's Fluicon foam applicator.

Production trials were run on several yards of CADD carpet. The carpet was a medium shade of a Kazan style color. The equipment used was a production dryer equipped with a Fluicon foam applicator and a large steamer. The CADD carpet was treated at 2% owf tannic acid. The tannic acid product was applied as foam to the carpet as it moved along the dryer range. The solution level was about 100% add-on. The steam time was about 4 minutes. After steaming, the carpet was rinsed, dried, and small samples cut for evaluation.

The observed results on the samples showed that the stainresistance to Red Dye 40 rated a 9 and the colorfastness to 10% bleach rated a 4-5. In addition, the Kazan shade showed no evidence of color change due to dye loss on the basic dyed nylon component of the carpet.

These results demonstrate that the invention can be applied to CADD nylon carpets at the manufacturing level.

Experiments 1a, 1b, 2a, 2b, and 3 show that tannic acid can be applied to Cat-Acid Differentially Dyeable (CADD) nylon carpets by the wet heat batch or wet heat continuous steam fixation methods to impart stainresistance to acid colorants such as Cherry Kool-Aid® and to neutral colorants such as French's® yellow mustard and Betadine while also imparting colorfastness to chemical agents such as 10% Clorox® bleach, benzoyl peroxide, and ozone. The tannic acid that is applied is greater than about 0.6% owf. Preferably, the tannic acid is in an amount from about 0.6% owf to about 5% owf, including all points in-between. More preferably, the tannic acid is in an amount from about 2% owf to about 5% owf, including all points in-between.

These experiments further show that the levels of color loss or shade change on CADD nylon carpets treated with tannic acid is minimal; whereas, the same carpets treated with an SAC, methacrylate, or maleic acid type stainblocker would show severe unacceptable color loss and shade change.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A process for improving the colorfastness, ozonefastness, and stainresistance of cationic dyeable nylon fibers dyed with basic dyestuffs wherein the process comprises the steps of treating the nylon fibers with a tannic acid product and then fixing the treated nylon fibers by a fixation method.

2. The process for improving the colorfastness, ozonefastness, and stainresistance of cationic dyeable nylon fibers according to claim 1, wherein the nylon fibers are treated with at least about 0.6% of tannic acid.

3. The process for improving the colorfastness, ozonefastness, and stainresistance of cationic dyeable nylon fibers according to claim 1, wherein the nylon fibers are treated with tannic acid in the range from about 0.6% owf to about 5% owf.

4. The process for improving the colorfastness, ozonefastness, and stainresistance of cationic dyeable nylon fibers according to claim 1, wherein the nylon fibers are treated with tannic acid in the range from about 2% owf to about 5% owf.

5. The process for improving the colorfastness, ozonefastness, and stainresistance of cationic dyeable nylon fibers according to claim 1, wherein the cationic dyeable nylon fibers have a stain resistance of about 8 or higher on the AATCC TM 175 scale.

6. The process for improving the colorfastness, ozonefastness, and stainresistance of cationic dyeable nylon fibers according to claim 1, wherein the cationic dyeable nylon fibers have a color change of about 4 or higher on the AATCC Grey Scale for color change.

7. A process for improving the colorfastness, ozonefastness, and stainresistance of cationic dyeable nylon fibers dyed with basic dyestuffs wherein the process comprises the steps of treating the nylon fibers with a tannic acid product and then fixing the treated nylon fibers by the wet heat method.

8. The process for improving the colorfastness, ozonefastness, and stainresistance of cationic dyeable nylon fibers according to claim 7, wherein the nylon fibers are treated with at least about 0.6% of tannic acid.

9. The process for improving the colorfastness, ozonefastness, and stainresistance of cationic dyeable nylon fibers according to claim 7, wherein the nylon fibers are treated with tannic acid in the range from about 0.6% owf to about 5% owf.

10. The process for improving the colorfastness, ozonefastness, and stainresistance of cationic dyeable nylon fibers according to claim 7, wherein the nylon fibers are treated with tannic acid in the range from about 2% owf to about 5% owf.

11. The process for improving the colorfastness, ozonefastness, and stainresistance of cationic dyeable nylon fibers according to claim 7, wherein the cationic dyeable nylon fibers have a stain resistance of about 4 or higher on the AATCC TM 175 scale.

12. The process for improving the colorfastness, ozonefastness, and stainresistance of cationic dyeable nylon fibers according to claim 7, wherein the cationic dyeable nylon fibers have a color change of about 4 or higher on the AATCC Grey Scale for color change.

13. A process for improving the colorfastness, ozonefastness, and stainresistance of cationic dyeable nylon fibers dyed with basic dyestuffs wherein the process comprises the steps of treating the nylon fibers with at least about 0.6% owf of a tannic acid product and then fixing the treated nylon fibers by the wet heat method.

14. The process for improving the colorfastness, ozonefastness, and stainresistance of cationic dyeable nylon fibers according to claim 13, wherein the tannic acid product is food grade quality.

15. The process for improving the colorfastness, ozonefastness, and stainresistance of cationic dyeable nylon fibers according to claim 13, wherein the nylon fibers are treated with tannic acid in the range from about 0.6% owf to about 5% owf.

16. The process for improving the colorfastness, ozonefastness, and stainresistance of cationic dyeable nylon fibers according to claim 13, wherein the nylon fibers are treated with tannic acid in the range from about 2% owf to about 5% owf.

17. The process for improving the colorfastness, ozonefastness, and stainresistance of cationic dyeable nylon fibers according to claim 13, wherein the cationic dyeable nylon fibers have a stain resistance of about 4 or higher on the AATCC TM 175 scale.

18. The process for improving the colorfastness, ozonefastness, and stainresistance of cationic dyeable nylon fibers according to claim 13, wherein the cationic dyeable nylon fibers have a color change of about 4 or higher on the AATCC Grey Scale for color change.

19. The process for improving the colorfastness, ozonefastness, and stainresistance of cationic dyeable nylon fibers according to claim 13, wherein the wet heat method is a wet heat steam method.

20. The process for improving the colorfastness, ozonefastness, and stainresistance of cationic dyeable nylon fibers according to claim 13, wherein the wet heat method is a wet heat continuous steam method.

* * * * *